United States Patent [19]

Morino et al.

[11] 4,245,594

[45] Jan. 20, 1981

[54] IGNITION DEVICE

[75] Inventors: Seiji Morino, Aichi; Hisasi Kawai, Toyohashi, both of Japan

[73] Assignee: Nippon Soken, Inc., Nishio, Japan

[21] Appl. No.: 68,735

[22] Filed: Aug. 22, 1979

[30] Foreign Application Priority Data

Sep. 28, 1978 [JP] Japan ..... 53-119699

[51] Int. Cl.[3] ..... F02P 1/00

[52] U.S. Cl. ..... 123/606; 315/209 T; 123/637

[58] Field of Search ..... 123/148 E; 315/209 T

[56] References Cited

U.S. PATENT DOCUMENTS

| | | | |
|---|---|---|---|
| 2,966,615 | 12/1960 | Meyer | 123/148 E |
| 3,035,108 | 5/1962 | Kaehni | 123/148 E |
| 3,626,910 | 12/1971 | Porsche | 123/148 E |
| 3,910,247 | 10/1975 | Hartig | 123/148 E |
| 3,945,362 | 3/1976 | Neuman | 123/148 E |
| 4,051,828 | 10/1977 | Topic | 123/148 E |
| 4,077,380 | 3/1978 | Canup | 123/148 E |

*Primary Examiner*—Ronald B. Cox

*Attorney, Agent, or Firm*—Cushman, Darby & Cushman

[57] ABSTRACT

When the contact breaker of a distributor is in the off position, pulses with constant frequency which are generated from an oscillating circuit are supplied to a transistor push-pull coupling which is connected to the primary coil of a transformer. In accordance with the transistor's constant frequency switching a discharge through the spark plugs connected to the secondary coil of the transformer is repeated.

6 Claims, 10 Drawing Figures

IGNITION DEVICE

BACKGROUND OF THE INVENTION

The present invention relates to ignition devices, and in particular to a spark plug with a long time and nearly continuous discharge.

In the conventional spark-ignition type engines, the ignition device consists of an ignition coil and a contact breaker, where for one working cycle of the engine the spark plug is instantaneously discharged and the electric spark of the discharge ignites the compressed fuel mixture.

However, with the above-mentioned device, when the fuel mixture is lean or too much of the exhaust gases are being recirculated, the ignition is not powerful enough thus creating problems such as increase in the fuel consumption and in the pollutants in the exhaust gases.

SUMMARY OF THE INVENTION

The object of the present invention is, in view of the problems mentioned above, to provide an ignition device with a simple construction comprising a spark-plug with nearly continuous discharges for a long time which results in reducing both the fuel consumption of the engine and the amount of the pollutants in the exhaust gases.

In the present invention the above-described object is attained, in particular, by operatively connecting and operating a transformer with an intermediate terminal, diodes and transistors.

DESCRIPTION OF THE PREFERRED EMBODIMENTS

Figure 1:
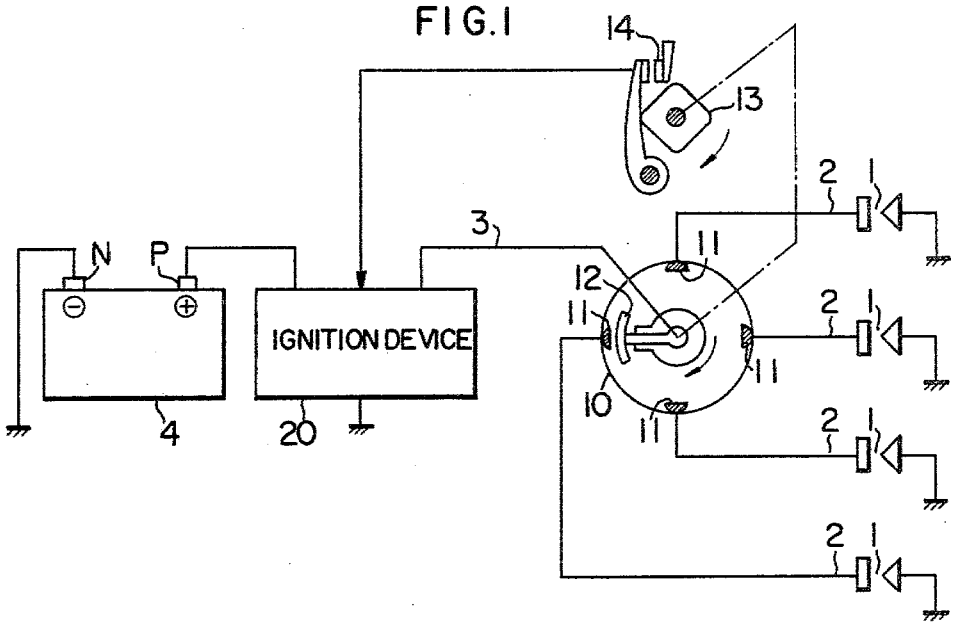
FIG. 1 is an overall structural drawing of one embodiment of the present invention.

In the following, the present invention will be described in detail with reference to some embodiments shown in the drawings. Referring to FIG. 1, spark plugs 1, which are well known and have a central electrode and a ground electrode shown here schematically, are placed in each cylinder head of the engine. The engine is not shown but it is to be understood to be a four cylinder, four cycle spark ignition type car engine.

From an ignition device 20 of the present invention, high tension is applied to the spark plugs 1 through a distributor 10, where in this construction the distributor 10 is connected to the spark plugs 1 with four high-tension cables 2 and to the ignition device 20 with a high-tension cable 3.

The distributor 10, being well known, consists of receiving electrodes 11 placed in a circle at regular intervals and a rotating electrode 12, which makes one turn for every two turns of the crankshaft of the engine, thus when the rotating electrode 12 comes close to each one of the receiving electrodes 11, a high voltage is applied by the ignition device 20 to the corresponding spark plug 1.

On the same shaft with the rotating electrode 12 of the distributor 10 there is rotating a 4 pointed cam 13 which makes and breaks the contact breaker 14, thus the on and off signal from the contact breaker 14 is supplied as an input to the ignition device 20 marking the start and finish periods of the electric discharge (ignition).

The ignition device 20 transforms the 12 volt direct current from a car battery 4, which is a direct current source, into a high voltage of 20 KV.

Figure 2:
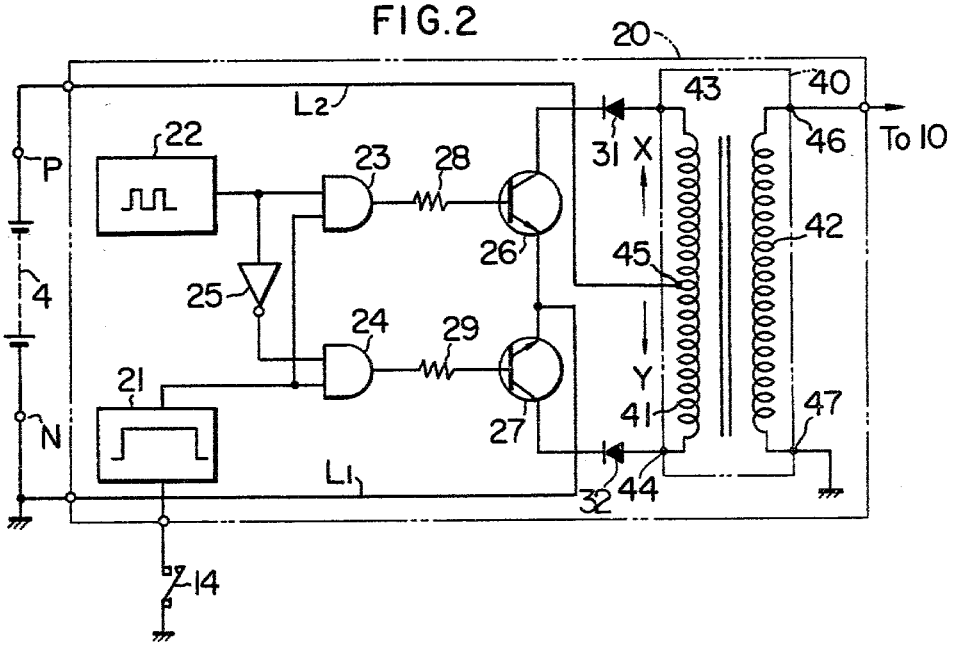
FIG. 2 is an electric circuit diagram of the ignition device shown in FIG. 1.

Now, referring to FIG. 2, the ignition device 20 is to be described in detail. A waveform shaping circuit 21 is a circuit of known type, which shapes the input signal into a square wave pulse signal, wherein the input signal is the on and off signal coming from the contact breaker 14.

An oscillating circuit 22 comprises an astable multivibrator of known type, which produces a square wave pulse signal with a constant frequency of around 5 KHz.

An AND gate 23 is an AND logic circuit for the output signals from the waveform shaping circuit 21 and the oscillating circuit 22 and when the output signal of the waveform shaping circuit 21 is at the "1" level it passes through the output pulse of the oscillating circuit 22, and when the output signal of the waveform shaping circuit 21 is at the "0" level the output from the AND gate 23 is always a "0" level signal.

An AND gate 24 is an AND logic circuit for the output signals from the waveform shaping circuit 21 and the output signal from an inverter 25, which is the inverted output signal from the oscillating circuit 22, wherein the AND gate 24 passes through the output pulse signal from the inverter 25 when the output from the waveform shaping circuit 21 is a "1" level signal, and gives a "0" level signal always when the output from the waveform shaping circuit 21 is a "0" level signal.

Two NPN type power transistors 26 and 27 are connected in such a way to the outputs of the AND gates 23 and 24 as to perform as a push-pull coupling, whereby the transistor 26 is connected with its base through a resistor 28 to the output terminal of the AND gate 23 and the other transistor 27 is connected with its base through a resistor 29 to the output terminal of the AND gate 24. Furthermore the transistors 26 and 27 are connected through corresponding diodes 31 and 32 to a transformer 40, wherein each of their collectors is connected to the corresponding cathode of the diodes 31 and 32. Finally, the emitters of the transistors 26 and 27 are connected with the conductor $L_1$ to the minus terminal N of the battery 4.

A transformer 40 comprises a primary coil 41 and a secondary coil 42 with a turn ratio of 1:100, wherein the voltage generated by the primary coil 41 is boosted by the secondary coil 42 so as to be an output. Terminals 43 and 44 of the primary coil 41 are connected to the anodes of the diodes 31 and 32, while an intermediate terminal 45, through the conductor $L_2$, is connected to the plus terminal P of the battery 4. A terminal 46 of the secondary coil 42 is connected to the rotating electrode 12 of the distributor 10, while the other terminal 47 is grounded.

Figure 3:
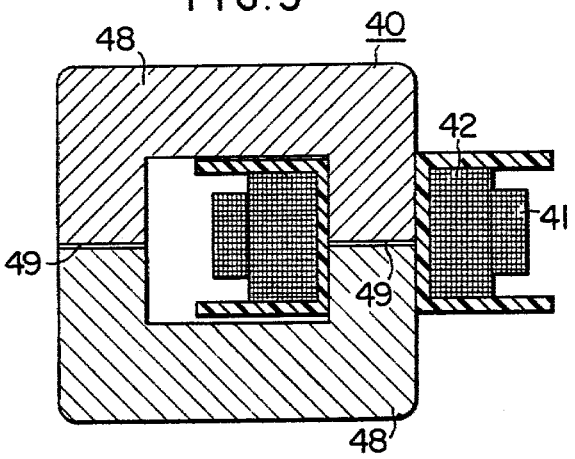
FIG. 3 is a cross-sectional view of the transformer shown in FIG. 2.

The primary coil 41 and the secondary coil 42 are wound in a bobbin as there it is shown in FIG. 3, around a pair of U-shaped ferrite cores 48, forming a close magnetic path, and also the magnetic circuit formed by the ferrite cores 48 is provided with two gaps 49 each thereof approximately 0.25 mm, thereby the combined gap is approximately 0.5 mm.

Figure 9:
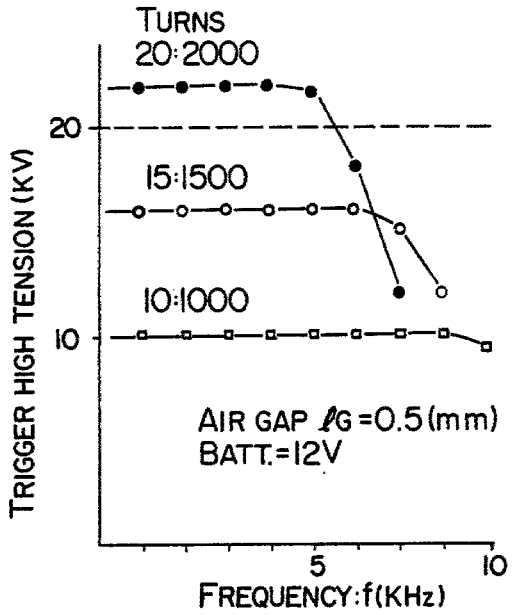
FIGS. 9 and 10 are graphs of the experimental results as from the present invention.
Figure 10:
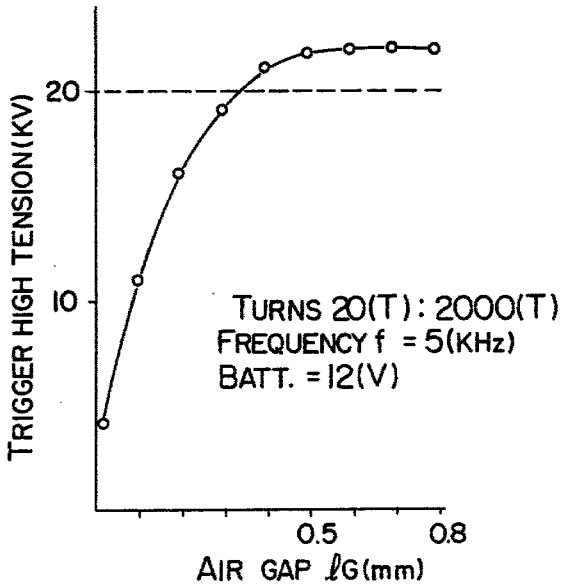

When the turn ratio of the primary and secondary coils is taken to be 1:100, the winding of the primary coil is to be of 20 turns and that of the secondary coil is to be of 2000 turns, which is determined as a result of experiments. In FIG. 9 there is shown the results of the experiments performed to determine the turn ratio, and FIG. 10 shows the relation between the trigger high-tension of the secondary coil 42 and the air gap of the ferrite cores 48. The highest tension is generated as it is evident from the relation, for an air gap of more than 0.5 mm. On the other hand, after generating the trigger high-tension and in order to maintain the discharge with increasing the square wave pulse voltage it is required that the gap should be made as small as possible.

Figure 4:
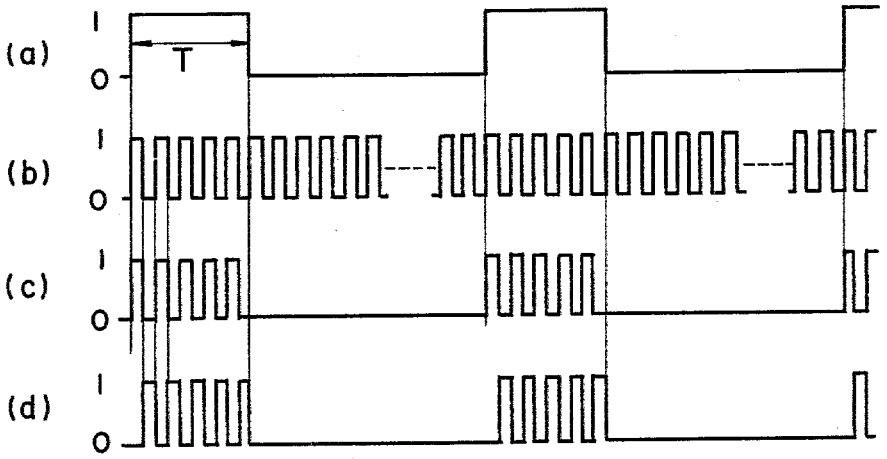
FIGS. 4 and 5 are voltage waveform charts of each part, illustrating the operation of the present invention.

When operating an engine with the above-described construction, the four pointed cam 13 of the distributor 10 rotates continuously thus making the contact of the contact breaker 14, open and close, whereby the waveform shaping circuit 21 of the ignition device 20 produces a square wave pulse signal with a pattern shown in FIG. 4(*a*). Namely, the waveform shaping circuit 21 produces a "1" level signal when the contact of the contact breaker 14 switches from on to off, and a "0" level signal when the contact of the contact breaker 14 switches from off to on.

The oscillating circuit 22 generates a square wave pulse signal with a constant frequency of 5 KHz as shown in FIG. 4(*b*), and the inverter 25 inverts this signal to a new pulse signal.

The AND gate 23 generates as a result a composite pulse signal shown in FIG. 4(*c*), and the other AND gate 24 generates the composite pulse signal shown in FIG. 4(*d*). The power transistors 26 and 27, in accordance to the output of each of the AND gates 23 and 24, are being switched on and off and for the period T, as shown in FIG. 4, since to the bases of both the power transistors 26 and 27 there are pulse signals in opposite phases applied, and therefore the power transistors 26 and 27 repeat the on-off operation.

Figure 5:
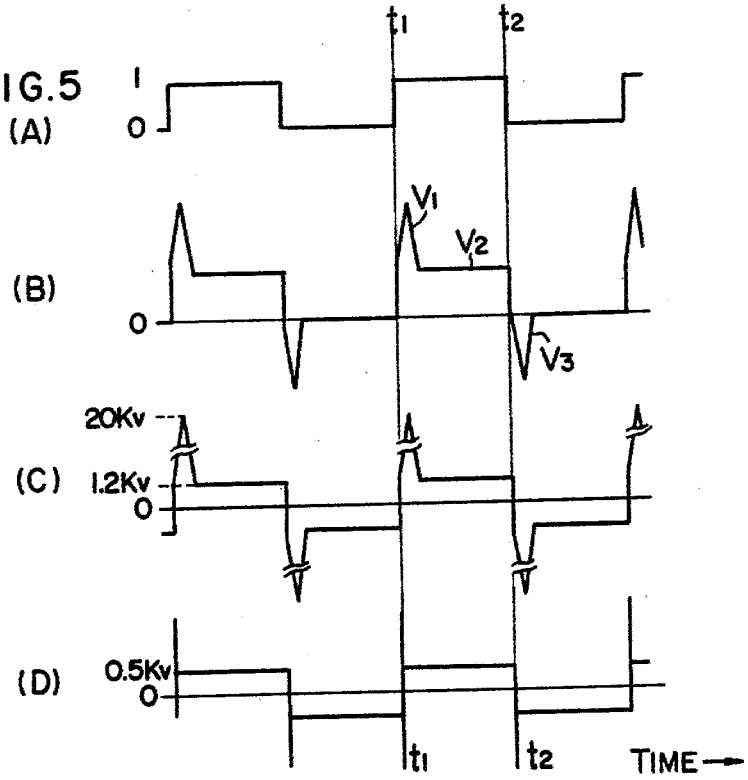

FIG. 5(A) represents the waveform shown in FIG. 4(*d*) for the period T in an enlarged time scale, wherein at the time $t_1$ at which the output of the AND gate 24 rises from the "0" level to the "1" level the power transistor 26 switches from on to off, while the other power transistor 27 switches from off to on.

Although the power transistor 26 is switched to off, the electric current of the primary coil flowing until that moment through the diode 31 and the power transistor 26 does not turn to zero instantaneously, thereby on the terminals 43 and 44 of the primary coil 41 a counter electromotive force in the direction shown with the arrow X in the FIG. 2 is generated.

Here, if the diode 32 were not provided the current of the primary coil would flow between the base and collector of the power transistor 27 and only small spike voltage would be generated at the terminal 43 of the primary coil 41. In the present invention, however, there is provided a diode 32 connecting the terminal 44 and the transistor 27, thus when the power transistor 26 has switched to off, the provided diode 32 shuts off the circuit between the collector and the base of the power transistor 27, and as there it is shown in FIG. 5(B) at the terminal 43 of the primary coil 41 a trigger high-tension $V_1$ is generated, which drops after to $V_2$ of about two times the battery voltage.

Likewise, at the time $t_2$ at which the square wave pulse turns from the "1" level to the "0" level, the power transistor 26 switches from off to on and the power transistor 27 switches from on to off.

Consequently, the primary coil current flowing through the diode 32 and the power transistor 27 is cut off and a counter electromotive force is generated in the primary coil 41 in the direction shown with an arrow Y in FIG. 2. Therefore, at the terminal 43 of the primary coil 41 a negative trigger high-tension $V_3$ is generated and thereafter it is to be the ground potential.

The above-described operation is repeated thus generating the waveform of the primary voltage shown in FIG. 5(B). From the secondary coil 42 of the transformer 40 is generated a boosted secondary voltage corresponding to the primary one, and thereafter it is applied to the spark plug 1.

When the secondary coil 42 is not loaded the waveform of the then generated secondary voltage is shown in FIG. 5(C) and in case a spark plug 1 has been connected, the waveform of the secondary voltage becomes as shown in FIG. 5(D).

Now, during the period T defined by the on-off switching of the contact breaker 14, the rotating electrode 12 of the distributor 10 comes close to one of the distributing electrodes 11 and to one of the spark plugs 1 a high tension is applied by the ignition device 20.

Thus, the spark plug 1 makes the capacitance-discharge in response to the secondary voltage which corresponds to the primary voltage $V_1$, after which in accordance with the secondary voltage corresponding to the primary voltage $V_3$ it makes the discharge continuously for a long time.

Subsequently, this is repeated and each spark plug 1 of each cylinder of the engine makes the discharge nearly continuous, for a long time and also to steadily and reliably ignite the fuel mixture in each combustion cycle.

The fuel mixture, supplied to the engine can be made lean or a considerable exhaust gas recirculation (EGR) can be performed without an adverse effect on the ignition power and the engine has a lower fuel consumption and the amount of pollutants in the exhaust gases is greatly reduced thereby.

Figure 6:
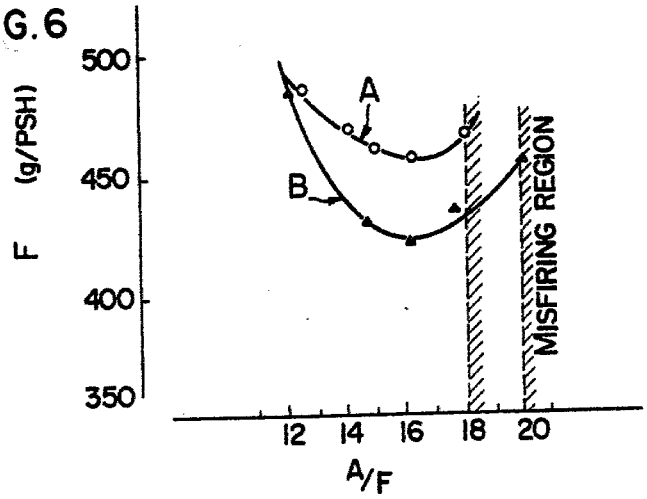
FIG. 6 is a graph which shows the relation between the air to fuel ratio and the fuel consumption.

The improvement in the fuel consumption is shown in FIG. 6, where in experiments performed under the conditions of 1400 rpm and a load of 1.2 kg-m and with an air to fuel ratio A/F of 14.8, equal to the stoichiometric one, the engine, when equipped with a conventional ignition device, has a fuel consumption shown with the curve A of a rate F of 460 (g/PS·H), and when equipped with the device of the present invention, the curve is that of B with a consumption rate of 425 (g/PS·H), which is a satisfactory result.

Further, in FIG. 6 there is shown that with a conventional ignition device for an air to fuel ratio larger than 18 there begins a misfiring region, which causes the engine to stop, while for the device of the present invention the misfiring region begins for an air to fuel ratio of more than 20 by means of which the increase in the efficiency of the ignition can also be explained.

Figure 7:
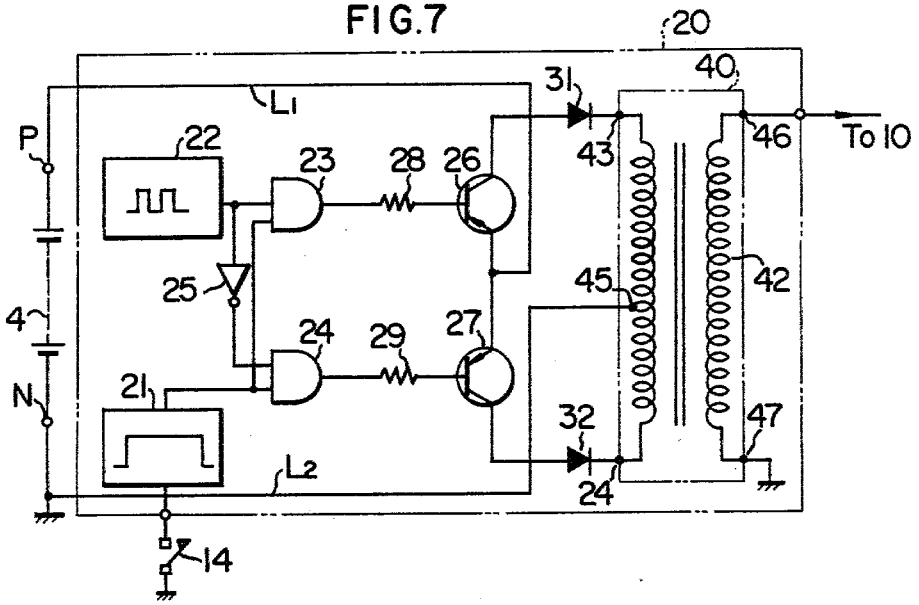
FIGS. 7 and 8 are electric circuit diagrams of other embodiments of the present invention.

Now, for the above described embodiment of this invention the power transistors 26 and 27 used are of NPN type, but it is shown in FIG. 7 that PNP type transistors can be used instead, when the connecting direction of the diodes 31 and 32 and the battery ground connection are turned to the opposite.

Figure 8:
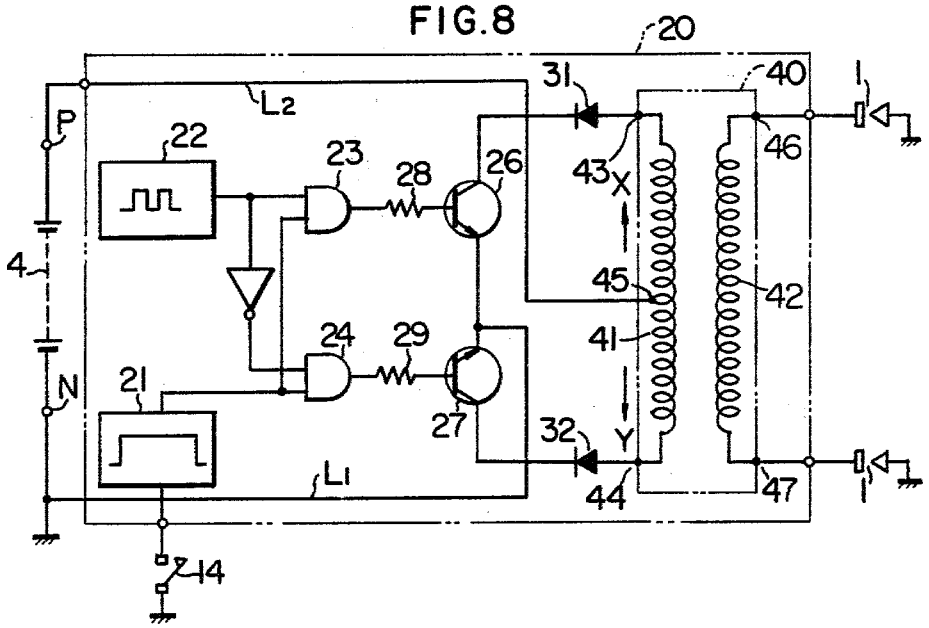

Furthermore, in the above-described embodiment, the distributor 10 has been used to distribute the high tension to the spark plugs 1, but in case of a two cylinder engine it is possible to connect directly the spark plugs 1 to the terminals 46 and 47 of the transformer 40 as shown in FIG. 8. It is understandable that the same system can be applied to a four cylinder engine if a pair of transformers 40 are provided.

The ignition device of the present invention is meant to be implemented not only for internal combustion engines but for gas turbines, boilers and the like.

We claim:

1. An ignition device for an engine comprising:

a magnetic core having an air gap;

a primary coil wound around said magnetic core and having an intermediate terminal being adapted to be connected to one end of a DC power source associated with said engine;

a secondary coil wound around said magnetic core and being adapted to be coupled at one end to a spark plug associated with said engine;

timing signal generating means for generating signals indicating the start and end of ignition of the engine;

means, coupled to said timing signal generating means, for generating pulse signals having a constant predetermined frequency from the start till end of the ignition; and a switching circuit including first and second switching elements each having a control input, said first switching element coupled at one end thereof to one end of said primary coil and the other end thereof being adapted to be connected to the other end of said DC power source, and said second switching element being coupled at one end thereof to the other end of said primary coil and at the other end thereof being adapted to be connected to the other end of said DC power source, diodes being provided between each said end of said primary coil and each said switching elements for preventing an inverse current from flowing therein, said control inputs being coupled respectively to said pulse signal generating means for receiving therefrom said pulses signals for controlling said switching elements to turn on and off an electric current through said primary coil alternately in response thereto, to thereby induce across said secondary coil an AC pulse voltage containing a peaked high voltage, at its leading edge, sufficient to trigger a discharge of said spark plug, and a subsequent high voltage sufficient to maintain the discharge of said spark plug.

2. An ignition device as defined in claim 1, wherein the air gap of said magnetic core is 0.5 .0 mm.

3. An ignition device as defined in claim 1, wherein the turn ratio of said primary and secondary coils is approximately 1:100, and said primary coil winding is 20 turns or more.

4. An ignition device as defined in claim 1, wherein said peaked high voltage is of greater magnitude than that of said subsequent high voltage.

5. An ignition arrangement for an engine comprising:

an ignition coil comprising:

a magnetic core having a gap therein;

a primary coil wound on said magnetic core and having two end terminals and a center tap, the center tap being adapted to be connected to one end of a DC power source associated with said engine; and a secondary coil wound on said magnetic core and being adapted at one end to be connected to a spark plug associated with said engine;

timing signal generating means, coupled to said engine for generating an ignition timing signal indicating a start ignition time and an end ignition time for the ignition of said engine;

ignition generator means, coupled to said timing signal generating means and to said primary coil, comprising:

means for generating a pulse signal, a push-pull stage, coupled to said pulse signal generating means and to said timing signal generating means, having two outputs respectively coupled to said two end terminals of said primary coil, and a pair of diodes, one such diode coupling each for said outputs of said push-pull stage to an end terminal of said primary coil, said ignition generator means for (a) inducing across said secondary coil, substantially at said ignition start time, an AC pulse voltage having, at its leading edge, a peaked high voltage sufficient to trigger a spark discharge of said spark plug, and (b) inducing across said secondary coil, subsequent to said peaked high voltage, a high voltage sufficient to maintain the spark discharge of said spark plug until said end ignition time.

6. An ignition arrangement according to either of claims 5 wherein said gap is an air gap of 0.5 mm. or more.

* * * * *